US005413832A

United States Patent [19]

Willey

[11] Patent Number: 5,413,832

[45] Date of Patent: May 9, 1995

[54] TUFTED PILE FABRIC FORMED FROM SPUN AND FILAMENT SPACE-DYED YARN

[75] Inventor: Richard C. Willey, LaGrange, Ga.

[73] Assignee: Milliken Research Corporation, Spartanburg, S.C.

[21] Appl. No.: 187,605

[22] Filed: Jan. 26, 1994

[51] Int. Cl.[6] ..... B32B 33/00; D04H 11/00

[52] U.S. Cl. ..... 428/92; 428/85; 428/97

[58] Field of Search ..... 428/92, 97, 85

[56] References Cited

U.S. PATENT DOCUMENTS

| | | | |
|---|---|---|---|
| 3,012,303 | 12/1961 | Whitaker et al. | 28/72 |
| 3,102,322 | 9/1963 | Whitaker | 28/72 |
| 3,120,422 | 2/1964 | Weir | 8/14 |
| 3,800,375 | 4/1974 | Harper, Jr. et al. | 28/72.16 |
| 3,982,490 | 9/1976 | Bury | 112/80.7 |
| 4,033,717 | 7/1977 | Whitaker | 8/14 |
| 4,100,863 | 7/1978 | Shortte, Jr. | 112/79 R |
| 4,216,735 | 8/1980 | McDaniel, Jr. | 112/410 |
| 4,224,884 | 9/1980 | Shortte, Jr. | 112/79 R |
| 4,329,143 | 5/1982 | Hutcheson | 8/483 |
| 4,338,090 | 7/1982 | Hutcheson | 8/478 |
| 4,522,857 | 6/1985 | Higgins | 428/95 |
| 4,877,669 | 10/1989 | Endrenyi, Jr. et al. | 428/92 |
| 5,040,276 | 8/1991 | Coons, III et al. | 28/220 |
| 5,160,347 | 11/1992 | Kay et al. | 8/481 |
| 5,199,958 | 4/1993 | Jenkins et al. | 8/539 |

*Primary Examiner*—George F. Lesmes
*Assistant Examiner*—Terrel Morris
*Attorney, Agent, or Firm*—Terry T. Moyer; James M. Robertson

[57] ABSTRACT

The fabric of the present invention includes a pile portion comprising spun yarn tufted in alternating arrangement with bulk continuous filament yarn through a base layer. The spun yarn includes a space-dyed component and a stock-dyed component. The bulk continuous filament yarn is also space-dyed. A process and apparatus for producing the pile fabric of the present invention are also provided.

6 Claims, 3 Drawing Sheets

TUFTED PILE FABRIC FORMED FROM SPUN AND FILAMENT SPACE-DYED YARN

FIELD OF THE INVENTION

The present invention relates to piled textile fabrics and more particularly to pile fabrics, such as carpeting, wherein the pile is formed from yarn tufted through a base fabric. The fabric of the present invention includes a pile portion comprising spun yarn tufted in alternating arrangement with bulk continuous filament yarn through a base layer. The spun yarn includes a space-dyed component and a stock-dyed component. The bulk continuous filament yarn is also space-dyed. A process and apparatus for producing the pile fabric of the present invention are also provided.

BACKGROUND OF THE INVENTION

The coloration of carpets and other piled fabrics represents an important consideration when determining the suitability of a particular fabric for a particular use. In many instances, the user may require a particularized pattern and multiple well known technologies are available for use in imparting such definite and distinct patterns to fabrics. As will be appreciated, however, in some settings a well defined pattern may not be desired for carpeting. Moreover, a solid color may also be undesirable. In such instances, carpeting having multiple colors arranged in a visually non-distinct organization to impart a random amorphous organization of color with no regular pattern of solid color may prove useful. Such coloration schemes are often referred to as imparting a "natural" look to the fabric.

The present invention provides a pile fabric having such an organization of color. The pile fabric has a pile portion which includes spun yarn in combination with bulk continuous filament yarn. The spun yarn is preferably two ply and includes one end of yarn space-dyed by a commercially available process twisted in conjunction with one end of solid stock dyed yarn. The bulk continuous filament yarn is also preferably two ply but is entirely space-dyed. The spun yarn and bulk continuous filament yarn are preferably tufted in alternating fashion through a base layer. A method and apparatus for forming such a pile fabric is also provided.

The prior art has recognized a number of schemes for imparting variations in color in piled fabric such as carpet. In U.S. Pat. No. 3,800,375 to Harper, Jr. et al., a process is disclosed for cross-dyeing cellulosic fabrics involving the selective dyeing of treated yarns in a woven fabric. U.S. Pat. Nos. 3,012,303 3,102,322 and 4,033,717 to Whitaker (all incorporated by reference) disclose tufted pile carpet formed from space dyed knit/de-knit yarn. U.S. Pat. No. 4,216,735 to McDaniel, Jr. (incorporated by reference) discloses a patterned tufted product formed from a space dyed polyester or polypropylene yarn tufted in conjunction with an undyed yarn having a susceptibility to a dye to which the polyester or polypropylene yarn is not susceptible in alternating rows in a high/low technique to form a carpet having a high/low design and thereafter dyeing the undyed yarn. U.S. Pat. Nos. 4,329,143 and 4,338,090 to Hutcheson (both incorporated by reference) disclose a simulated Berber yarn and process for producing the same which process includes the selective dyeing of a knit prefabric. U.S. Pat. No. 5,160,347 to Kay et al., discloses a process for preparing a tufted rug including the tufting of space dyed yarns of "carrier" fibers in combination with undyed yarns of "carrierless" polyester fibers and/or nylon fibers. The rug is then dyed with a cationic acid or disperse dye appropriate to the dye receptivity of the undyed yarns while avoiding of the overdyeing of the space-dyed yarns to produce a multicolor piece-dyed area rug.

Significantly, none of these references disclose the ability to use spun yarn such as multi-ply spun yarn having a space-dyed component in combination with a space-dyed filament yarn in a tufted fabric to achieve coloration without the occurrence of some sort of visually perceptible pattern such as stripes, chevrons, color blocks, or the like. Rather, it is believed that heretofore, the combination of spun and filament yarn in the same tufted fabric was largely thought to be unworkable. Specifically, prior to the present invention it was generally thought that the use of spun yarn in combination with filament yarn in the same tufted fabric would lead to problems such as tangling of the spun fibers with the fibers of the bulk continuous filament yarn which necessarily leads to undesirable downtime of the tufting apparatus.

Further, the prior art seems to indicate that the occurrence of visually discernable patterning is inevitable with the use of space-dyed yarn in piled fabric and thus either presents alternatives to the use of such space-dyed yarns or techniques such as selective dyeing to cover up such patterning.

SUMMARY AND OBJECTS

In view of the foregoing, it is an object of the present invention to provide a tufted pile fabric such as a carpet fabric formed from space-dyed yarn elements to create a seemingly random, natural, amorphous coloration across the surface of the piled fabric without distinct patterning or patches of color.

It is a further object of the present invention to provide a method for forming a tufted pile fabric such as a carpet fabric from space-dyed yarn elements such that the surface of the piled fabric has a substantially amorphous coloration without distinct patterning or patches of color.

It is still a further object of the present invention to provide an apparatus for forming a tufted pile fabric such as a carpet fabric from a spun yarn in combination with a bulk continuous filament yarn wherein both the spun yarn and the bulk continuous filament yarn may have space-dyed components.

Accordingly, it is a feature of the present invention to provide a carpet formed from space-dyed yarn tufted through a base layer in a predetermined fashion to yield an amorphous coloration scheme without visually distinct patterning such as stripes, chevrons, or blocks of solid color across the surface of the carpet.

It is a subsidiary feature of the present invention to provide a tufted carpet having a pile portion with an amorphous surface coloration wherein the pile portion is formed from multi-ply spun yarn having a space-dyed component in alternating tufted arrangement with space-dyed bulk continuous filament yarn.

It is a further subsidiary feature of the present invention to provide a tufted carpet having a pile portion with an amorphous surface coloration wherein the pile portion is formed from a two ply spun yarn having one space dyed end and one stock dyed end in alternating tufting arrangement with space-dyed bulk continuous filament.

It is yet a further subsidiary feature of the present invention to provide a process and related apparatus for forming a tufted carpet wherein spun yarn is tufted in alternating arrangement with bulk continuous filament yarn.

In accordance with one aspect of the present invention, a tufted pile fabric is provided for use as a carpet. The tufted pile fabric includes a pile portion extending outwardly from a base or backing portion. The pile portion comprises a plurality of tufts of bulk continuous filament yarn in alternating arrangement with tufts of spun yarn. The tufts of bulk continuous filament yarn include yarn which has been space-dyed with a plurality of colors. The tufts of spun yarn comprise multi-ply yarn formed from a plurality of spun singles wherein at least one of the spun singles is space-dyed with a plurality of colors.

In accordance with another aspect of the present invention, a method for forming a tufted carpet fabric is provided comprising the steps of:

(a) forming a bulk continuous filament yarn;
(b) space dyeing the bulk continuous filament yarn formed in step (a);
(c) spinning singles yarn from stock dyed staple;
(d) spinning singles yarn from undyed staple;
(e) space-dying the singles yarn spun in step (d);
(f) twisting a multi-ply spun yarn from the singles yarn spun in step (c) and the singles yarn space-dyed in step (e); and
(g) tufting the bulk continuous filament yarn space-dyed in step (b) in alternating arrangement with the multi-ply spun yarn twisted in step (f).

In accordance with still another aspect of the present invention, an improved apparatus for forming tufted carpet from spun yarn in alternating arrangement with bulk continuous filament is provided, including a frame, a needle bar mounted on the frame, a needle plate mounted under the needle bar having a plurality of spaces therein to accommodate a plurality of needles mounted on the needle bar, and means to supply backing material to the needle bar, wherein the improvement comprises: a dual yarn feed assembly for delivery of spun yarn and bulk continuous filament yarn to the needle bar such that the spun yarn and the bulk continuous filament yarn are conveyed separately prior to delivery to the needle bar, the dual yarn feed assembly including a spun yarn feed assembly and a filament yarn feed assembly, wherein the spun yarn feed assembly includes a spun yarn guide for passage of spun yarn, a pair of spun yarn feed rolls in the path of the spun yarn subsequent to the spun yarn guide, a spun yarn separator bar in subsequent relation to the spun yarn feed rolls and an eccentric in subsequent relation to the spun yarn separator bar and wherein the filament yarn feed assembly includes a pair of filament yarn separator rolls which feed a pair of filament yarn rolls which in turn feed a filament yarn eccentric.

While the invention will now be described and disclosed in connection with certain preferred embodiments and procedures, it is not intended to limit the invention to these specific embodiments. Rather, it is intended to cover all such alternative embodiments and modifications as may fall within the true spirit and scope of the invention as defined by the appended claims.

DESCRIPTION

Figure 1:
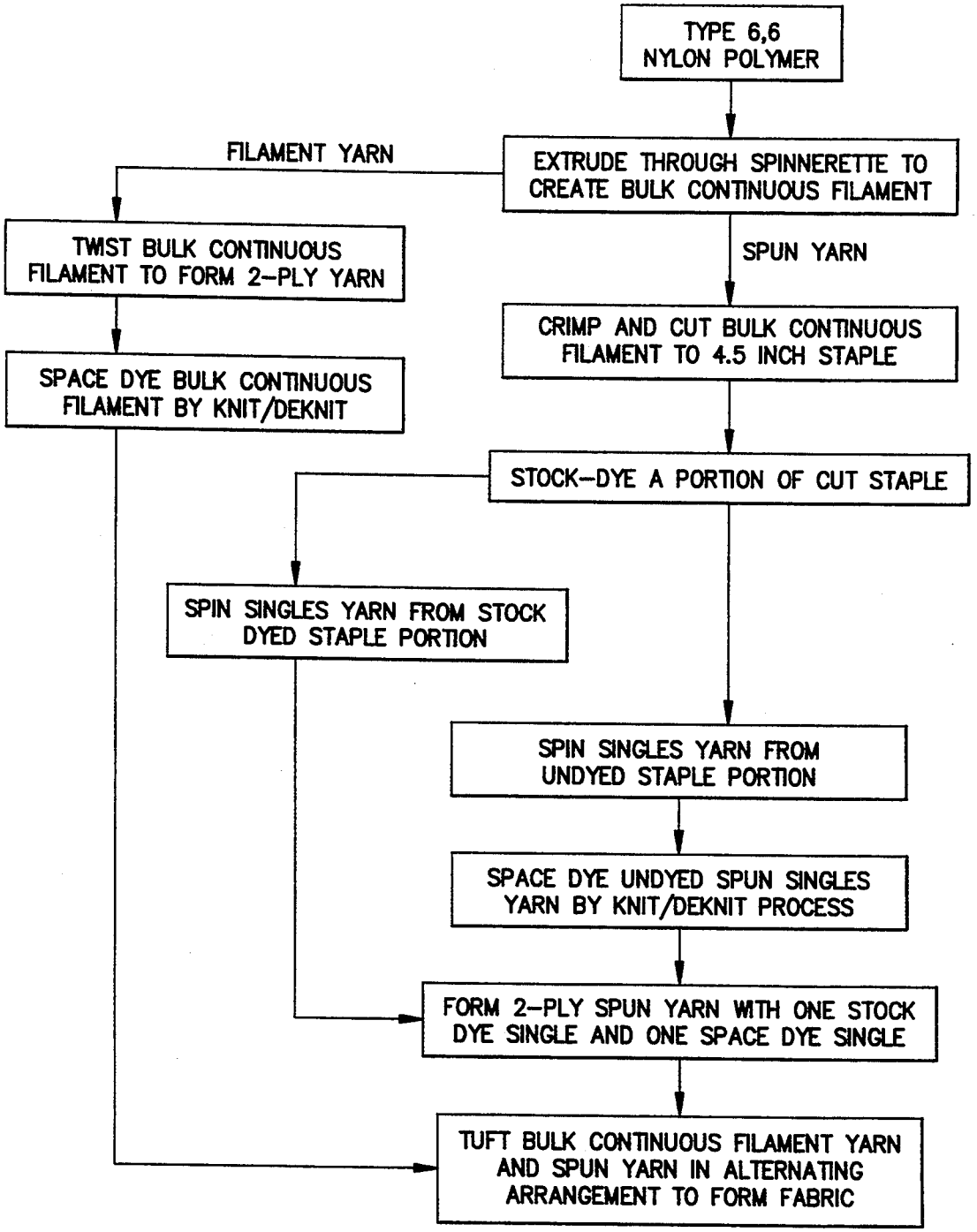
FIG. 1 is a flow diagram illustrating the preferred steps and materials for forming the tufted pile fabric of the present invention.

Turning now to the drawings, in FIG. 1 is shown a flow diagram illustrating the general steps involved in the preferred process of forming the pile fabric of the present invention. As indicated, in general the preferred starting material for the yarn of the pile fabric of the present invention is the polyamide nylon 6,6 available from DuPont Fibers of Wilmington, Del. The nylon 6,6 is preferably extruded through a spinerette to generate bulk continuous filament in a manner well known to those of skill in the art. It is to be understood that a number of other fiber materials nay also be suitable. By way of example only, and not limitation, other materials which might be utilized include other polyamides such as nylon 6; polyesters such as polyethylene terephthalate (PET), and polybutylene terephthalate (PBT); polyolefins such as polyethylene and polypropylene; rayon; and polyvinyl polymers such as polyacrylonitrile as well as other fibers suitable for tufting.

In the preferred process, the bulk continuous filament is separated into two portions following extrusion through the spinerette. One portion is used to form filament yarn while the other portion is used to form spun yarn as described hereafter.

With regard to the spun yarn, the bulk continuous filament is preferably crimped and cut into staple segments approximately 4.5 inches in length. A portion of the staple segments is thereafter stock dyed with a dye, preferably an acid dye, as is well known to those of skill in the art, although it is to be understood that alternative dyes may be utilized as may be appropriate for the yarn material which is being utilized. The portion of the staple segments which is stock dyed is then spun into singles yarn by conventional spinning methods. The singles yarn formed from the stock dyed staple segments preferably has a yarn number of approximately 2.25/1 as based on the cotton count system. In the preferred practice, this stock dyed singles yarn will have a "Z" twist with approximately 4.5 turns per inch.

The portion of the staple lengths which is not stock dyed is preferably spun into a singles yarn which is substantially similar in its physical make-up to the stock dyed singles yarn. The undyed spun singles yarn is thereafter space-dyed with a plurality of colors by means of a commercial knit/deknit process. Knit/deknit space-dyeing processes are described in U.S. Pat. Nos. 3,012,303, 3,102,322, and 4,033,717 to Whitaker (incorporated by reference) and 4,329,143 to Hutcheson (incorporated by reference). As disclosed in these references, in the preferred process the yarn is knit into a prefabric such as a sock or tube and thereafter applied with a plurality of colors by means of a multiplicity of rolls. The prefabric is then raveled to effect a deknitting, thereby leaving the individual dyed yarns. A potentially preferred commercial source for the space-dyeing of the yarn is the Fred Whitaker Company of Roanoke, Va.

In the preferred embodiment, the singles yarn formed from the undyed staple lengths is space-dyed in a commercial operation with up to 5 different colors which appear in segments along the length of the yarn once the prefabric is deknitted. The use of a number of different colors across the knit prefabric results in a color breakup which does not readily repeat. A portion of the sequence of colors as measured on one commercially available space-dyed yarn for use in the pile fabric of the present invention is illustrated in Table I.

TABLE I (Continued)

| Segment Number | Color | Segment Length (Inches) |
|---|---|---|
| 1 | Aqua | 4.5 |
| 2 | Cream | 5 |
| 3 | Purple | 7.5 |
| 4 | Cream | 3 |
| 5 | Blue | 8.5 |
| 7 | Cream | 3.5 |
| 8 | Aqua | 11.75 |
| 9 | Cream | 5 |
| 10 | Purple | 8.5 |
| 11 | Blue | 7.75 |
| 12 | Cream | 4.5 |
| 13 | Aqua | 14 |
| 14 | Cream | 6.5 |
| 15 | Purple | 3.75 |
| 16 | Blue | 4 |
| 17 | Cream | 5.5 |
| 18 | Aqua | 6.5 |
| 19 | Cream | 4.75 |
| 20 | Aqua | 6.75 |
| 21 | Cream | 15.5 |
| 22 | Aqua | 5 |
| 23 | Cream | 10.5 |
| 24 | Aqua | 8.75 |
| 25 | Cream | 9.25 |
| 26 | Aqua | 7.5 |
| 27 | Cream | 5 |
| 28 | Blue | 2 |
| 29 | Purple | 5 |
| 30 | Cream | 3 |
| 31 | Aqua | 15 |
| 32 | Cream | 4.75 |
| 33 | Blue | 4.25 |
| 34 | Purple | 6.5 |
| 35 | Cream | 4 |
| 36 | Aqua | 14 |
| 38 | Cream | 4 |
| 39 | Blue | 5 |
| 40 | Cream | 2 |
| 41 | Purple | 7.5 |
| 42 | Cream | 4.25 |
| 43 | Aqua | 9.25 |
| 44 | Blue | 7.5 |
| 45 | Cream | 7.25 |
| 46 | Purple | 9 |
| 47 | Cream | 4 |
| 48 | Cream | 8.25 |
| 49 | Blue | 5 |
| 50 | Cream | 3.5 |
| 51 | Aqua | 3 |
| 52 | Cream | 4.5 |
| 53 | Purple | 10.75 |
| 54 | Cream | 6.25 |
| 55 | Blue | 8 |
| 56 | Cream | 3.5 |
| 57 | Aqua | 8 |

TABLE I-continued (Continued)

| Segment Number | Color | Segment Length (Inches) |
|---|---|---|
| 58 | Cream | 4.25 |
| 59 | Purple | 8 |
| 60 | Blue | 10.5 |
| 61 | Cream | 4.25 |
| 62 | Aqua | 10.75 |
| 63 | Cream | 5.5 |
| 64 | Purple | 6.5 |
| 65 | Blue | 6.75 |
| 66 | Cream | 5 |
| 67 | Aqua | 14 |
| 68 | Cream | 5.75 |
| 69 | Purple | 3 |
| 70 | Blue | 5.25 |
| 71 | Cream | 6.25 |
| 72 | Aqua | 6.5 |
| 73 | Cream | 7 |
| 74 | Aqua | 9 |
| 75 | Cream | 13 |
| 76 | Aqua | 5.5 |
| 77 | Cream | 5 |
| 78 | Purple | 2 |
| 79 | Cream | 4.75 |
| 80 | Aqua | 8 |
| 81 | Cream | 6.5 |
| 82 | Aqua | 8.75 |
| 83 | Cream | 4.75 |
| 84 | Blue | 3 |
| 85 | Purple | 4.5 |
| 86 | Cream | 4.25 |
| 87 | Aqua | 18.5 |
| 88 | Cream | 4 |
| 89 | Blue | 4 |
| 90 | Purple | 7.25 |
| 91 | Cream | 6 |
| 92 | Aqua | 13 |
| 93 | Cream | 4.75 |
| 94 | Blue | 4 |
| 95 | Cream | 3 |
| 96 | Purple | 7.25 |
| 97 | Cream | 5.5 |
| 98 | Aqua | 5 |
| 99 | Cream | 8 |
| 100 | Blue | 5.5 |
| 101 | Cream | 10 |
| 102 | Purple | 8 |
| 103 | Cream | 11.5 |
| 104 | Blue | 6 |
| 105 | Cream | 3.75 |
| 106 | Aqua | 4 |
| 107 | Cream | 4.75 |
| 108 | Purple | 9.5 |
| 109 | Cream | 5 |
| 110 | Blue | 8.5 |
| 111 | Cream | 3.75 |
| 112 | Aqua | 8.75 |
| 113 | Cream | 5 |
| 114 | Purple | 7.5 |
| 115 | Blue | 9.5 |
| 116 | Cream | 4.75 |
| 117 | Aqua | 13 |
| 118 | Cream | 5.5 |
| 119 | Purple | 5.75 |
| 120 | Blue | 5.75 |
| 121 | Cream | 4.5 |
| 122 | Aqua | 5.5 |
| 123 | Cream | 2.25 |
| 124 | Aqua | 7.5 |
| 125 | Cream | 6.75 |
| 126 | Cream | 10 |
| 127 | Aqua | 99 |
| 128 | Cream | 7 |
| 129 | Aqua | 8.5 |
| 130 | Cream | 12 |
| 131 | Aqua | 6 |
| 132 | Cream | 4 |
| 133 | Purple | 2.75 |
| 134 | Cream | 4.5 |

TABLE I-continued (Continued)

| Segment Number | Color | Segment Length (Inches) |
|---|---|---|
| 135 | Aqua | 10 |
| 136 | Cream | 4 |
| 137 | Aqua | 10.5 |
| 138 | Cream | 3.5 |
| 139 | Blue | 2.25 |
| 140 | Purple | 4.25 |
| 141 | Cream | 4 |
| 142 | Aqua | 16.5 |
| 143 | Cream | 4 |
| 144 | Blue | 4.25 |
| 145 | Purple | 8 |
| 146 | Cream | 3.5 |
| 147 | Aqua | 13.5 |
| 148 | Cream | 4.75 |
| 149 | Blue | 5.25 |
| 150 | Cream | 2.5 |

As indicated by the data in Table I, the color spacing in the space-dyed singles yarn of the present invention is extremely diverse. That is, the space-dying of the yarn does not generate a readily discernable repeating pattern.

Once the space-dying is performed as described above, the space-dyed singles yarn is twisted with the stock dyed singles yarn previously described to form a multi-ply (preferably two ply) spun yarn. Due to the preferred use of the singles yarn as described above, the two ply spun yarn which is formed preferably has a yarn number of approximately 2.25/2 with an "S" twist having about 3.6 turns per inch although it is contemplated that these yarn characteristics may be varied to some degree as desired by the skilled practitioner.

As indicated previously, the pile fabric of the present invention comprises bulk continuous filament yarn tufted in alternating arrangement with the multi-ply spun yarn described above. As with the spun yarn, the bulk continuous filament yarn is preferably formed from nylon 6,6 filament in a manner well known to those of skill in the art to form a two-ply nylon filament yarn of approximately 1410 denier with a "S-Z" twist and about 3.0×3.0 turns per inch. Once the bulk continuous filament yarn has been formed, it is preferably space-dyed with up to about 5 different colors by means of the knit/deknit process as described above. The Fred Whitaker Company of Roanoke, Va. is a potentially preferred source for the commercial space-dying of the bulk continuous filament yarn.

While space-dyed yarns have long been available, the accepted belief in the art has been that the use of space-dyed yarns in a carpet product leads to the occurrence of distinct, visually discernable patterns showing up across the surface of the pile fabric. These patterns may appear in the form of colored blocks, stripes or chevron-shaped arrangements. This problem with the use of space-dyed yarn in carpet is specifically recognized in U.S. Pat. No. 3,120,422 to Weir, wherein the problem is addressed by using a dye injection technique to color the yarns rather than space-dyeing. This phenomenon is also recognized in U.S. Pat. No. 4,033,717 to Whitaker wherein the problem is addressed by an over dyeing of the carpet.

As will be appreciated, the occurrence of distinct patches of color, stripes, streaks and chevrons may be undesirable from an aesthetic standpoint since such elements may detract from the perception of natural continuity across the surface of the pile fabric produced. It has been found that by forming the pile fabric of the present invention from the yarns described above in an alternating arrangement by means of the following improved tufting apparatus, a piled fabric which avoids the occurrence of chevrons, stripes, color blocks and other visually discernable patterns can be produced.

Figure 2:
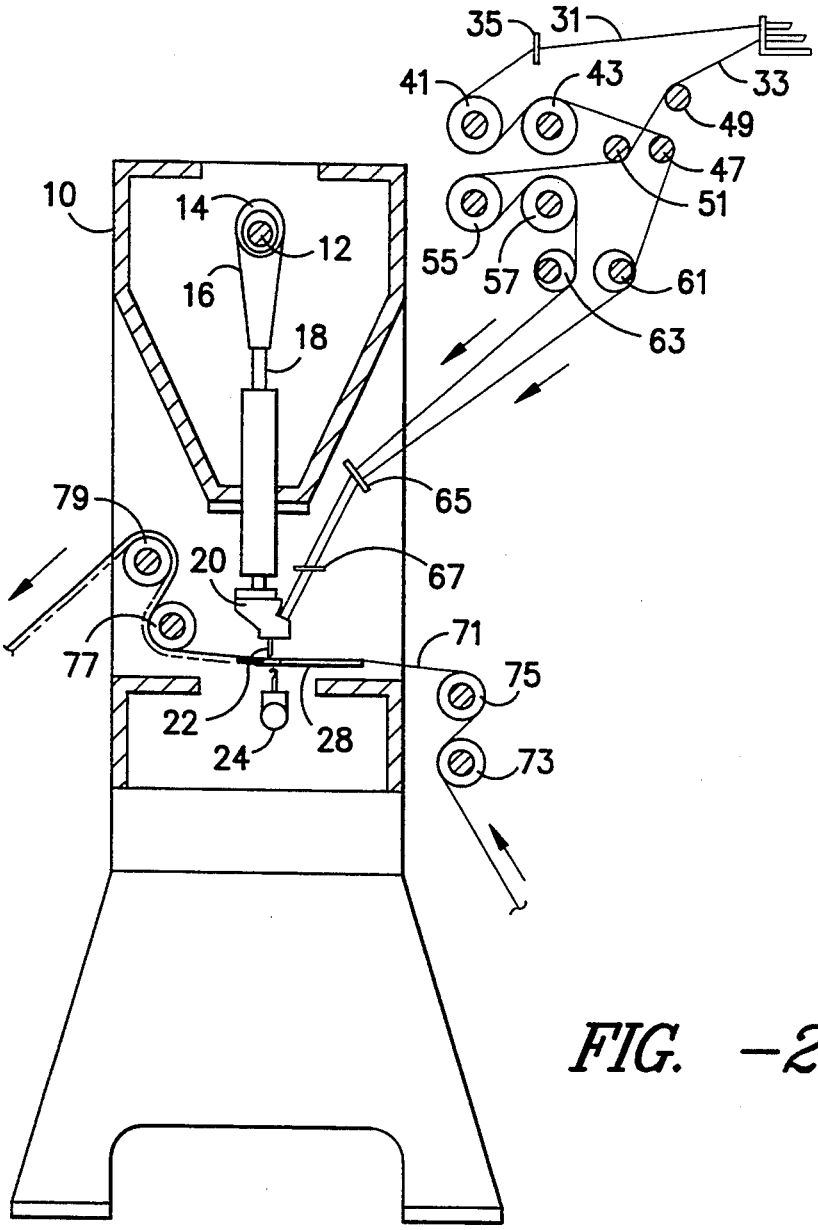
FIG. 2 is a sectional view of a potentially preferred apparatus for use in forming the tufted pile fabric of the present invention including an improved dual yarn feed assembly for feeding both spun and filament yarn to a tufting needle bar.

The improved tufting apparatus of the present invention is illustrated in FIG. 2. With the exception of the dual yarn feed assembly, the improved tufting apparatus is substantially similar to that described in U.S. Pat. Nos. 4,100,863 and 4,224,884 to Shortte Jr. (both incorporated by reference). Specifically, the tufting apparatus of the present invention comprises a frame 10, on which is supported a crankshaft 12, the eccentric 14, a connecting rod 16, the needle bar push rod 18, the needle bar 20, a row of tufting needles 22 with cooperating loopers 24 and a needle plate 28.

The dual yarn feed assembly as will now be described delivers the spun yarn 31 and the bulk continuous filament yarn 33 independently to the needle bar 20 from separate yarn rolls (not shown). Importantly, any interaction between the spun yarn 31 and the bulk continuous filament yarn 33 is avoided until the needle bar 20 is reached. In the illustrated and preferred embodiment, the spun yarn 31 is passed through a spun yarn guide 35 and over two spun yarn feed rolls 41, 43. After the spun yarn 31 passes over the spun yarn feed rolls 41, 43 it is passed over a first separator bar 47 which is disposed in intermediate relation to a second separator bar 49 and a third separator bar 51. As illustrated, the first, second and third separator bars 47, 49, and 51 serve to keep the spun yarn 31 from straying into the path of the bulk continuous filament yarn 33.

While the spun yarn 31 is being passed through the spun yarn feed rolls 41, 43 and around the first separator bar 47, the bulk continuous filament yarn 33 is passed over the second separator bar 49 and beneath the third separator bar 51 and preferably behind the path of the spun yarn 31 as shown. The bulk continuous filament yarn is thereafter passed around and through two filament yarn rolls 55, 57.

Both the spun yarn 31 and the bulk continuous filament yarn 33 are thereafter preferably passed over separate eccentric rolls 61, 63. The spun yarn 31 and the bulk continuous filament yarn 33 are kept independent from one another by passage through a first dual yarn guide 65 and a second dual yarn guide 67 just before delivery to the needle bar 20 for insertion by the tufting needles 22. It is believed that such complete separation between the spun yarn 31 and the bulk continuous filament yarn 33 accounts for the improved ability to avoid problems such as tangling of the fibers which creates a multitude of machine stops leading to undesirable down time which has been previously associated with attempts to combine these yarn types in the same tufted product.

In operation, once the spun yarn 31 and the bulk continuous filament yarn 33 are delivered to the needle bar 20, the backing material 71 to be tufted is delivered into the tufting machine by front feed rolls 73, 75. The spun yarn and bulk continuous filament yarn are thereafter tufted through the backing material in alternating fashion by shifting the needle bar 20 one gauge over and back on successive stitches. The tufted material may thereafter be withdrawn by take-up rolls 77 and 79. The resulting desired yarn organization is represented in FIG. 3, wherein shaded blocks represent tufts of spun yarn 31 and non-shaded blocks represent tufts of bulk continuous filament yarn 33.

Figure 3:
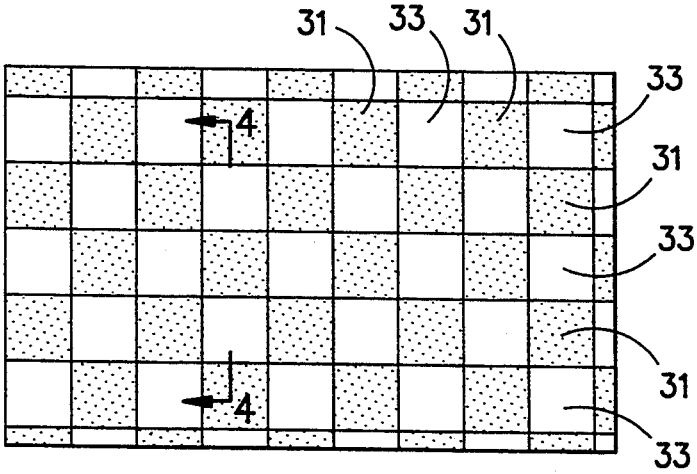
FIG. 3 shows a preferred organization scheme for the yarns in the tufted fabric of the present invention.
Figure 4A:
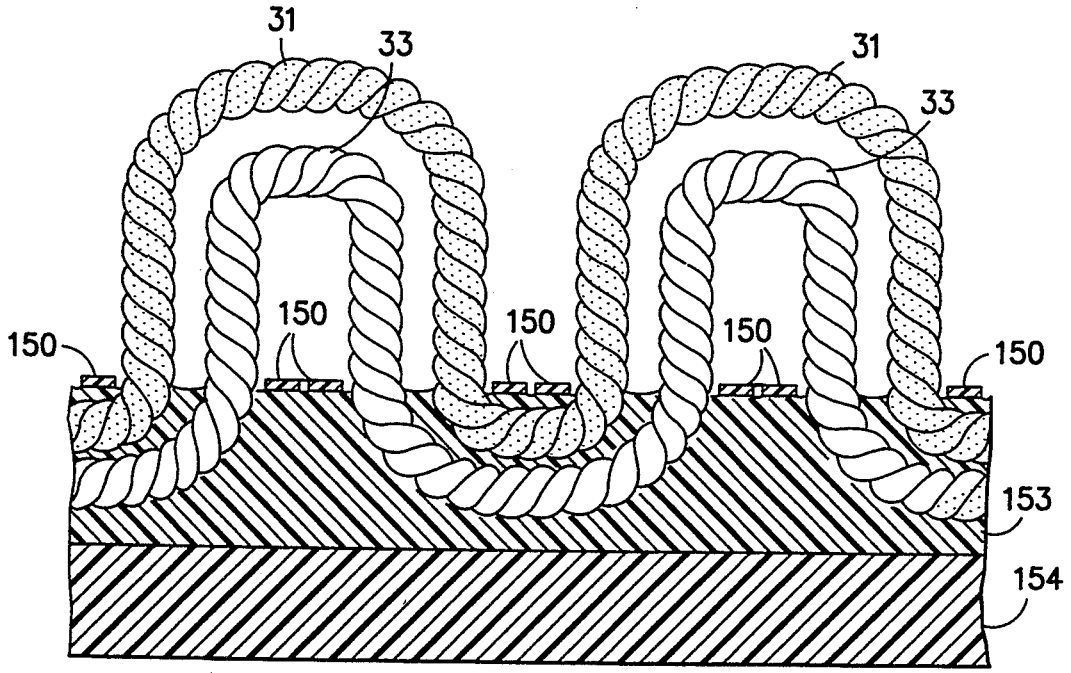
FIG. 4A is a cut-away view taken generally along line 4—4 of FIG. 3 showing the pile forming configuration of the tufted fabric of the present invention immediately after tufting.
Figure 4B:
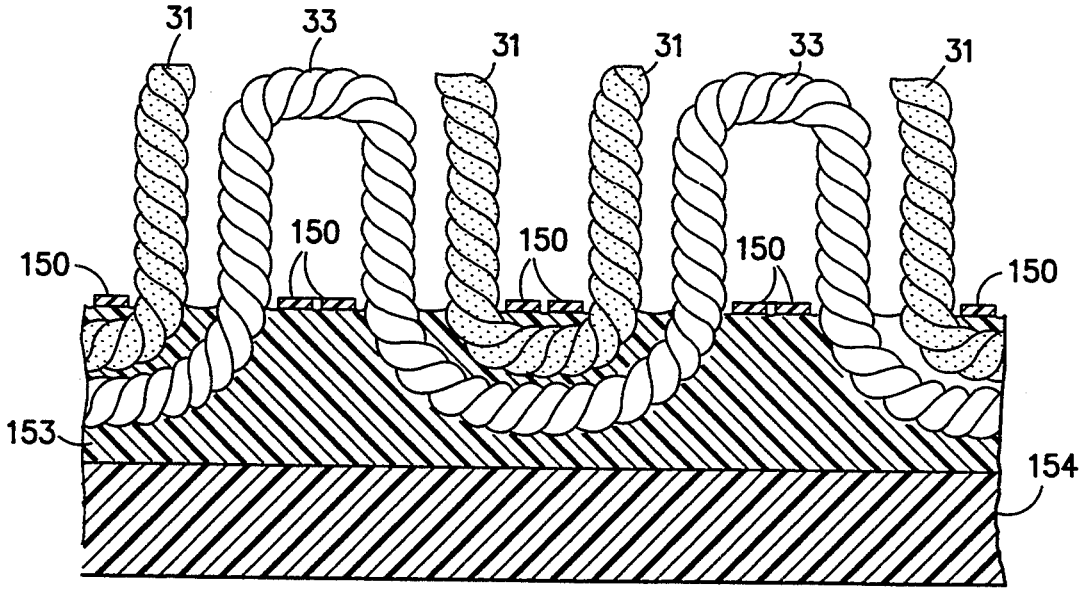
FIG. 4B is a cut-away view taken generally along line 4—4 of FIG. 3 showing the pile forming configuration of the tufted fabric of the present invention subsequent to a tip shear following tufting.

A cross sectional view of the cut pile tufted fabric of the present invention taken general along line 4—4 of FIG. 3 is shown in FIGS. 4A and 4B. As illustrated, the spun yarn 31 and the bulk continuous filament yarn 33 form the pile portion of the cut pile tufted fabric. The spun yarns and bulk continuous filament yarns are preferably tufted through a conventional polypropylene backing 150 as is well known in the art. Every other end in each direction (i.e. the spun end) is typically tufted to a higher pile height than the bulk continuous filament yarn (FIG. 4A). However, a shearing operation subsequent to tufting levels the pile to a uniform height preferably yielding the cut pile configuration illustrated in FIG. 4B.

In the final product, an adhesive precoat layer 153 such as a hot melt or latex adhesive as are well known to those of skill in the art is preferably used to hold the individual tufts in place with an adjacent backing layer 154 being used to provide stability if desired. As will be appreciated, additional cushioning and stabilizing layers may be added if desired as disclosed in U.S. Pat. No. 4,522,857 to Higgins (incorporated by reference).

While specific embodiments of the invention have been shown and described, it will be understood that the invention is in no way limited thereto, since modifications may be made and other embodiments of the principles of this invention will occur to those skilled in the art. Therefore, it is contemplated by the appended claims to cover any such modifications and other embodiments as incorporate the features of the present invention within the true spirit and scope of the following claims.

The present invention may be further understood by reference to the following Example which is not to be construed as unduly limiting the invention, which is defined by the appended claims.

EXAMPLE

Using a tufting apparatus similar to that shown in FIG. 2, a cut pile tufted carpet was formed by tufting alternate ends of spun yarn and bulk continuous filament yarn through a primary backing of woven polyester by means of a needle bar shift process. The spun yarn was a two-ply spun yarn having a yarn number of approximately 2.25/2. One ply of the spun yarn was formed from nylon 6,6 singles yarn space-dyed by the Fred Whitaker Company of 941 Industry Avenue, S.E. in Roanoke, Va. This space-dying imparted four colors(cream, aqua, blue, and purple) as described in Table 1.

The other ply of the spun yarn was formed from nylon 6,6 singles yarn which was stock dyed with a dye mixture of premetallized Irgalan Yellow 3RL (0.039%), premetallized Irgalan Black 8BL (0.050%), and premetallized Irgalan Bordeaux (0.015%) all from Ciba Geigy Chemical in Greensboro, N.C. in water at about 60% with the remainder being a standard gum mix including Guargum (0.46%) and wetting agent (0.19%) from Rohne Poulenc, a defoamer (0.2%) from Milliken Chemical and acidic acid (0.258%).

The bulk continuous filament yarn was twisted from nylon 6,6 filament to form a two-ply 1410 denier nylon yarn with an "S-Z" twist and about 3.00×3.00 turns per inch. This bulk continuous filament yarn was also space-dyed by the Fred Whitaker company as previously described.

The spun ends which were higher than the filament ends were tip sheared to create a cut and loop pile. The product produced had the following desired physical parameters.

| | | |
|---|---|---|
| Gauge | ⅛ | inch |
| Rows | 10.2 | per inch |
| Tufts | 81.6 | per square inch |
| Finished pile height | 0.156 | inches |
| Nominal total thickness | 0.284 | inches. |

What is claimed is:

1. A pile fabric, comprising:

a tufted pile portion extending from a backing portion, said pile portion including tufts of bulk continuous filament yarn in alternating arrangement with tufts of spun yarn, said tufts of bulk continuous filament yarn including yarn space-dyed with a plurality of colors, said tufts of spun yarn comprising multi-ply spun yarn formed from a plurality of spun singles wherein at least a portion of said plurality of spun singles is space-dyed with a plurality of colors.

2. The invention as in claim 1, wherein a portion of said plurality of spun singles is stock-dyed.

3. The invention as in claim 1, wherein said multi-ply spun yarn is two-ply yarn.

4. A tufted pile fabric, comprising:

a pile portion and a backing portion, wherein said pile portion comprises a plurality of multi-ply spun yarns and bulk continuous filament yarns tufted through said backing portion, said spun yarns and said bulk continuous filament yarns being tufted through said backing portion in alternating arrangement, said bulk continuous filament yarns being space-dyed with a plurality of colors and said spun yarn having at least one space-dyed ply and one stock-dyed ply.

5. The invention as in claim 4, wherein said bulk continuous filament yarns are formed from a polymer selected from the group consisting of nylon 6 and nylon 6,6.

6. The invention as in claim 4, wherein said spun yarn is formed from a polymer selected from the group consisting of nylon 6, and nylon 6,6.

* * * * *